US005352404A

United States Patent [19]

Yoshioka et al.

[11] Patent Number: 5,352,404

[45] Date of Patent: Oct. 4, 1994

[54] PROCESS FOR FORMING CONTACT MATERIAL INCLUDING THE STEP OF PREPARING CHROMIUM WITH AN OXYGEN CONTENT SUBSTANTIALLY REDUCED TO LESS THAN 0.1 WT. %

[75] Inventors: Nobuyuki Yoshioka; Toshimasa Fukai; Yasushi Noda; Nobutaka Suzuki, all of Tokyo, Japan

[73] Assignee: Kabushiki Kaisha Meidensha, Tokyo, Japan

[21] Appl. No.: 965,203

[22] Filed: Oct. 23, 1992

[30] Foreign Application Priority Data

| | | | |
|---|---|---|---|
| Oct. 25, 1991 | [JP] | Japan | 3-279994 |
| Oct. 29, 1991 | [JP] | Japan | 3-282715 |
| Nov. 6, 1991 | [JP] | Japan | 3-289612 |
| Jan. 21, 1992 | [JP] | Japan | 4-8269 |

[51] Int. Cl.[5] ..... B22F 1/00; C22C 38/60; C22C 33/00

[52] U.S. Cl. ..... 419/31; 75/351; 419/38; 419/57; 420/41; 420/71

[58] Field of Search ..... 75/337, 343, 351, 363; 420/428, 491, 495, 587, 588, 41, 71; 419/31, 32, 46, 38, 57

[56] References Cited

U.S. PATENT DOCUMENTS

| | | | |
|---|---|---|---|
| 2,246,328 | 7/1939 | Smith | 148/33 |
| 2,268,939 | 4/1941 | Hensel | 420/500 |
| 2,975,256 | 7/1958 | Lee et al. | 200/144 R |
| 3,246,979 | 6/1966 | Lafferty et al. | 420/491 |
| 3,779,714 | 12/1973 | Nadkarini et al. | 75/234 |
| 4,170,466 | 9/1979 | Klar | 75/337 |
| 4,302,514 | 11/1981 | Kato et al. | 428/569 |
| 4,315,770 | 2/1982 | Nadkarni | 75/343 |
| 4,537,745 | 8/1985 | Hassler et al. | 75/10.13 |
| 4,766,274 | 8/1988 | Iyer et al. | 200/144 |
| 4,784,829 | 11/1988 | Okumura et al. | 420/428 |

FOREIGN PATENT DOCUMENTS

| | | |
|---|---|---|
| 0469578 | 2/1992 | European Pat. Off. . |
| 3226604 | 1/1984 | Fed. Rep. of Germany . |
| 3729033 | 3/1988 | Fed. Rep. of Germany . |
| 3810218 | 10/1988 | Fed. Rep. of Germany . |
| 9015425 | 12/1990 | PCT Int'l Appl. . |
| 2066298 | 7/1981 | United Kingdom . |

OTHER PUBLICATIONS

World Patents Index-Derwent-Week 8241-An 82-86878 JP-A-57-143454-Sep. 4, 1982.

*Primary Examiner*—Donald P. Walsh
*Assistant Examiner*—Anthony R. Chi
*Attorney, Agent, or Firm*—Bachman & LaPointe

[57] ABSTRACT

A process for forming contact material of an electrode comprises the steps of preparing chromium of which oxygen content is substantially reduced, forming a molten mixture of the chromium and copper, atomizing the molten mixture into fine particles to obtain Cu-Cr alloyed powder, compacting Cu-Cr alloyed powder under desired pressure, and sintering the compacted alloyed powder. The oxygen content of the chromium may be reduced until less than 0.1 wt %. In a course of the process, a metal having melting point lower then copper may be blended. The metal may be blended in Cu-Cr alloyed powder, or blended in the molten mixture of copper and chromium. Alternatively, the process further includes the steps of forming a second molten mixture of copper and a metal having melting point lower than copper, atomizing the second molten mixture into fine particles to obtain alloyed powder of copper and the metal, and blending Cu-Cr alloyed powder with the alloyed powder of copper and the metal. The metal may be selected from one or mixture of the metals consisting of bismuth, lead, tellurium, antimony and selenium.

18 Claims, 2 Drawing Sheets

PROCESS FOR FORMING CONTACT MATERIAL INCLUDING THE STEP OF PREPARING CHROMIUM WITH AN OXYGEN CONTENT SUBSTANTIALLY REDUCED TO LESS THAN 0.1 WT. %

BACKGROUND OF THE INVENTION

1. Field of The Invention

The present invention relates generally to a process for forming contact material. Specifically, the present invention relates to a process for forming contact material which may be used as an electrode of a vacuum interrupter.

2. Description of The Background Art

Commonly, as contact material which forms an electrode, higher current breaking ability is required when that is utilized for a vacuum interrupter.

Copper-Chromium (Cu-Cr) alloy is well known as contact material having good current breaking ability. Conventionally, Cu-Cr alloy is formed by powder metallurgy techniques, i.e., copper (Cu) powder prepared by electrolytic methods and chromium (Cr) powder prepared by milling are mixed then compacted under pressure. The compacted powder is sintered to obtain desired Cu-Cr alloy. In order to obtain a suitable electrode material indicating desired electric characteristics, homogeneous distribution of Cr into a Cu matrix is necessary. Further to say, the finer diameter of Cr particle, the better for the material.

However, particle distribution in materials of Cr prepared mechanically by milling methods becomes widely dispersed. Additionally, homogeneous fineness of Cr particle cannot be established easily because mean diameter of Cr particles becomes about 40 μm. Therefore, weight variation occurs due to differing particle sized, differing specific gravity and differing distribution of particles, and such Cr particles cannot be homogeneously mixed with Cu powder. Therefore, after sintering, Cr particles cannot also be dispersed finely and homogeneously in the Cu matrix of a compacted article. Thus, electric characteristics of the article become degraded than those expected.

Commonly, Cu-Cr alloy is composed of a Cu matrix and Cr particles distributed therein. In order to obtain a desired electrode material having desired electric characteristics, Cr particle size must be decreased as fine as possible, and homogeneous distribution of such fine particles of Cr in the Cu matrix must be established.

Further milling of Cr particle using mechanical techniques is available to obtain fine particle size, but the surface of Cr particle is susceptible to the effects of oxygen in a course of mechanical processes. Therefore, oxidation of the Cr particle surfaces occurs in the process of milling and during storage. Sinterability of the mixed powder becomes reduced with increase of oxygen contained in Cr particle.

Classification of Cr particles using sieving means and selecting Cr particles only having fine particle diameter are effective for homogeneous distribution of fine particle, however, it causes severe degradation of yield and raises production cost.

Infiltration of Cr particle into voids generated in a compacted article of Cu particle, or infiltration of Cu particle into voids generated in a compacted article of a mixture of Cu and Cr after sintering at low temperature have been utilized to obtain desired characteristics. However, infiltratability of Cr particle becomes degraded because Cr at which surface is oxidized is difficult to wet. Generally, Cr particle tends to be easily oxidized, therefore, quality control of Cr particle is very difficult.

Casting methods for forming Cu-Cr alloy cannot be adopted, as the slow cooling speed of alloy solidification allows the size of Cr particles in the Cu matrix to be increased. Therefore, uniform distribution of fine Cr particles cannot be accomplished easily. Further to say, segregation is apt to occur during solidification. This causes quality of the article obtained from Cu-Cr alloy to be maldistributed.

Recently, atomization technique has been utilized for disintegrating a mixture of alloy elements into fine alloyed powder in place of using a mechanical milling technique.

However, in the process of atomization, oxygen content of Cr particle of material tends to be increased by certain amounts of impurities included therein. This increases oxygen content in an electrode obtained then degrades current breaking ability thereof. Additionally, Cr particle becomes difficult to melt because oxidized film is generated on the surface of the particle. Therefore, Cr particle becomes difficult to atomize from a nozzle. In order to sufficiently melt the particle, temperature of Cu-Cr molten alloy must be raised. However, because common temperature of producing the molten alloy is relatively high, i.e., 1600° to 1700° C., heat-stability of heated members, such as a heater, a heat insulator, and a crucible must be required to raise the temperature more than that of the aforementioned. This increases manufacturing cost.

SUMMARY OF THE INVENTION

It is therefore a principal object of the present invention to provide a process for forming contact material having good current breaking ability, low contact resistance, and good welding durability.

It is another object of the present invention to provide a process for forming contact material including Cu-Cr alloy in which fine particles of Cr are uniformly dispersed in a Cu matrix.

In order to accomplish the aforementioned and other objects, a process for forming contact material comprises the steps of preparing chromium (Cr) of which oxygen content is substantially reduced, forming a molten mixture of the chromium and copper, atomizing the molten mixture into fine particles to obtain Cu-Cr alloyed powder, compacting Cu-Cr alloyed powder under desired pressure, and sintering the compacted alloyed powder. The oxygen content of the chromium may be reduced until less than 0.1 wt %.

In a course of the process, a metal having melting point lower than copper may be blended.

The metal may be blended in Cu-Cr alloyed powder, or blended in the molten mixture of copper and chromium. Alternatively, the process further includes the steps of forming a second molten mixture of copper and a metal having melting point lower than copper, atomizing the second molten mixture into fine particles to obtain alloyed powder of copper and the metal, and blending Cu-Cr alloyed powder with the alloyed powder of copper and the metal.

The metal may be selected from one or mixture of the metals consisting of bismuth(Bi), lead(Pb), tellurium(Te), antimony(Sb) and selenium(Se).

BRIEF DESCRIPTION OF THE DRAWINGS

The present invention will be understood more fully from the detailed description given herebelow and from the accompanying drawings of the preferred embodiments of the invention. However, the drawings are not intended to imply limitation of the invention to a specific embodiment, but are for explanation and understanding only.

In the drawings.

DESCRIPTION OF THE PREFERRED EMBODIMENT

Figure 1:
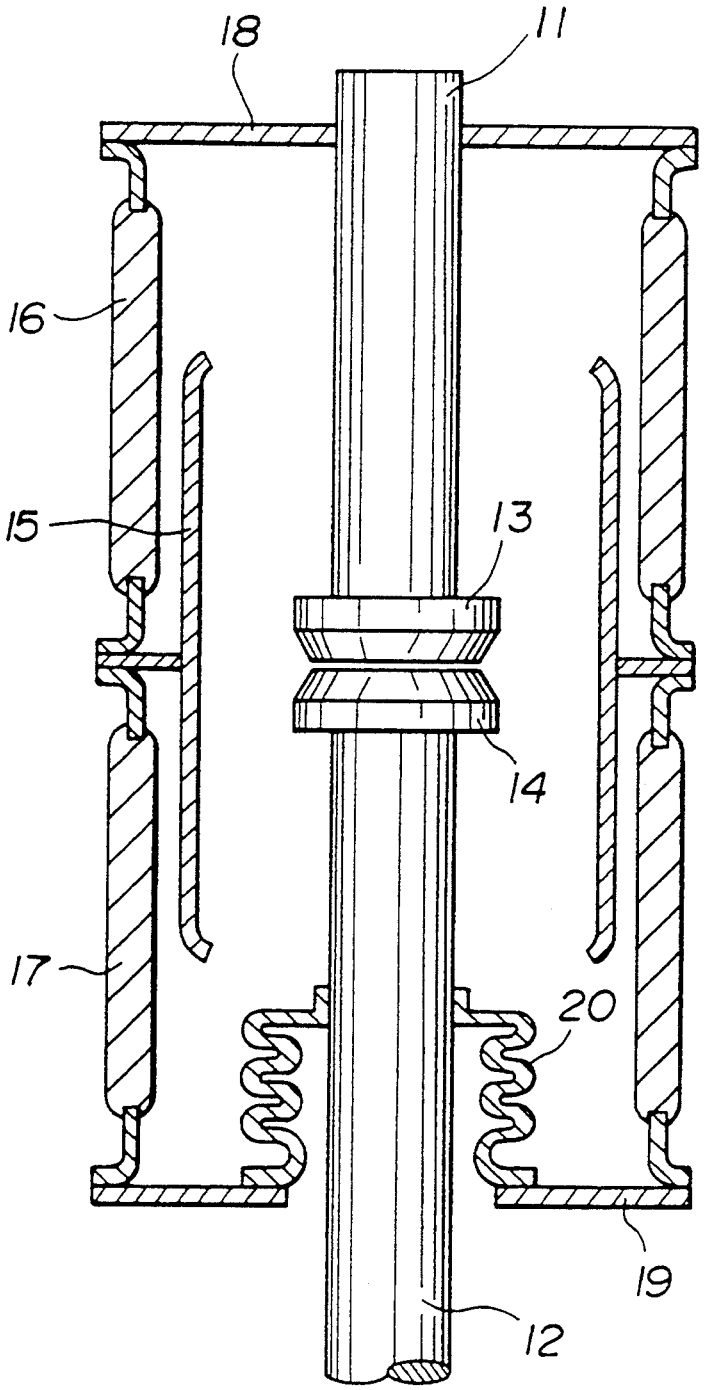
FIG. 1 is a sectional view of a vacuum interrupter in which an electrode made of contact material formed by the present invention is assembled.

Referring now to FIG. 1, showing a vacuum interrupter in which an electrode made of contact material formed by the process of the present invention is assembled, a pair of rods 11 and 12 are coaxially located so as to have facing surfaces at a first end of each rod. A pair of electrodes 13 and 14 are attached to both facing surfaces by waxing means. A cylindrical shield 15 is located so as to surround the rods 11 and 12. The center portion of the outer circumference of the shield 15 is supported by a pair of insulating cylinders 16 and 17, which are located to surround the shield 15. A metal plate 18 is placed on the open end of the insulating cylinder 16 so as to close the opening thereof at the open end. The metal plate 18 is passed through by a second end of the rod 11 to fix the rod 11 integrally with the metal plate 18 by establishing engagement of the both. A second end of the rod 12 is movably supported by a metal plate 19 via a bellows 20 and connected with a driving device not shown. The metal plate 19 is fixed to the open end of the insulating cylinder 17 so as to close the opening thereof at the open end. The rod 12 is reciprocately movable toward and away from the direction of the rod 11 when the driving device is operated. Concurrently, the electrode 14 attached to the movable rod 12 is reciprocately moved toward and away from the electrode 13 attached to the fixed rod 11.

In order to measure electric characteristics of the electrode formed by the process of the present invention, following examinations were accomplished using the vacuum interrupter of FIG. 1.

Firstly, preferred oxygen content of the Cr initially used (Cr material) was studied.

Mixture of Cr powder of which oxygen content had been preliminarily reduced and Cu powder were melted to obtain a molten alloy of Cu-Cr. The molten alloy was disintegrated into fine particles by atomization to form Cu-Cr alloyed powder. Oxygen content in the Cu-Cr alloyed powder was measured. Then, the alloyed powder was compacted and sintered by heating. Oxygen content in the sintered article obtained was measured. Table 1 shows the results.

TABLE 1

| Oxygen content (wt %) | | |
|---|---|---|
| Cr material | Cu—Cr alloyed powder | Sintered article |
| 0.3 | 0.25 | 0.28 |
| 0.1 | 0.12 | 0.15 |

TABLE 1-continued

| Oxygen content (wt %) | | |
|---|---|---|
| Cr material | Cu—Cr alloyed powder | Sintered article |
| 0.03 | 0.05 | 0.08 |

Oxygen content of the sintered article can be reduced less than 0.15 wt % when that of the Cr material is reduced less than 0.1 wt %.

Figure 2:
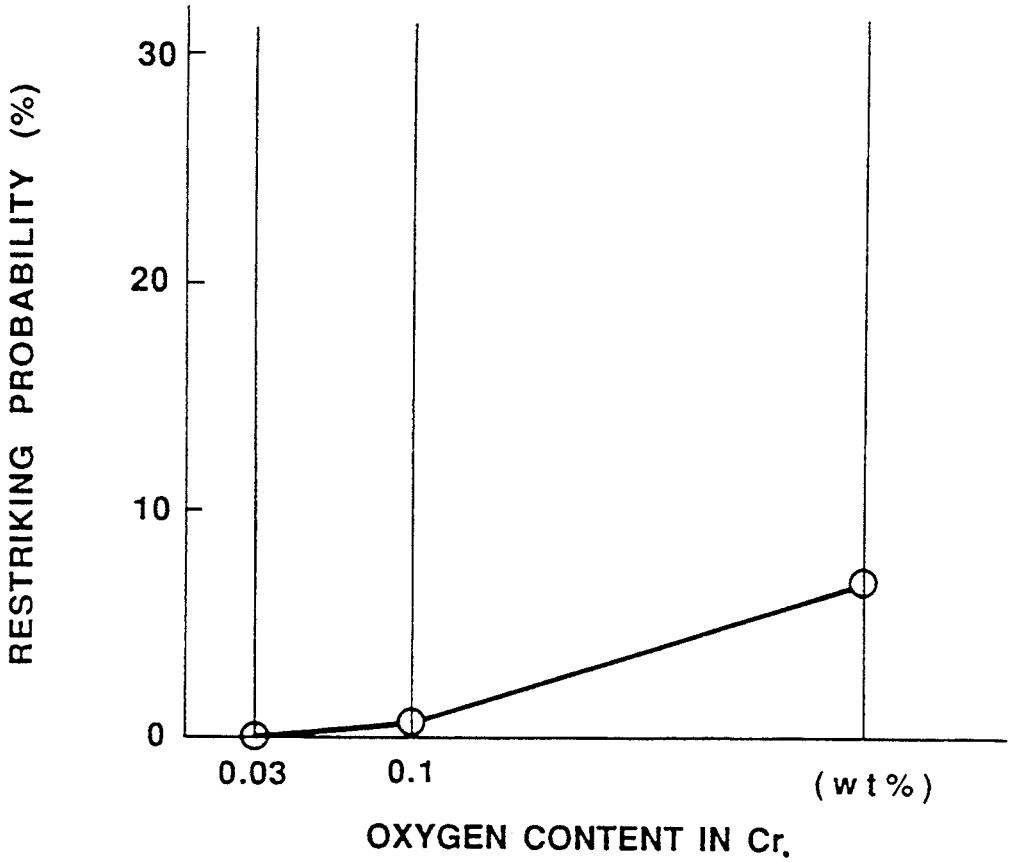
FIG. 2 is a graph showing a relationship between oxygen content(wt %) in Cr material and restriking probability.

The sintered article was mechanically processed in a spiral electrode having 40 mm of diameter and assembled in a vacuum interrupter. Thereafter, 100 times of breaking under conditions of 7.2 kV–20 kA were accomplished. Thus, restriking probability of the sintered article was measured from the number of restriking. FIG. 2 shows the results obtained. As indicated in the figure, restriking probability can be significantly reduced when oxygen content of the Cr material is reduced less than 0.1 wt %. Therefore, current breaking ability of the article can be improved.

Cu was put into a fire resisting crucible and melted at 1200° C. Then, Cr having a briquette form including less than 0.1 wt % of oxygen was put into the crucible while temperature was raised until 1700° C. The amount of Cr was determined to 20 wt % against that of Cu. Thus, Cu-Cr molten mixture was obtained. The molten mixture was atomized at 5 to 8 MPa of pressure using Ar gas to form Cu-Cr atomized alloyed powder. Here, from microscopic analysis, Cr particles having diameter of less than 5 μm were uniformly dispersed in the alloyed powder. Cu-Cr alloyed powder was filled into a die having 42 mm of diameter, compacted under 490 MPa of pressure to obtain a green compact. The green compact was sintered by heating at 1050° C. for 30 min. in a vacuum furnace of $5\times10^{-5}$ Torr. The sintered article obtained had 95 wt % of filling rate(ratio against theoretical density), 50 wt % IACS of electric conductivity. Oxygen content of the article was less than 0.15 wt %. When sintering, diameter of Cr particles dispersed in the Cu matrix can be controlled in some extent by controlling temperature or time for sintering. The sintered article was mechanically processed in an electrode having 40 mm of diameter, and used as the electrodes 13 and 14 of the vacuum interrupter of FIG. 2 to measure electric characteristics thereof. According to measurement, it was found that restriking probability was significantly reduced. That is, arc generated was smoothly diffused because Cr particles were uniformly dispersed in the Cu matrix as the aforementioned. Therefore, current breaking ability was improved. In addition, contact resistance was reduced by minimization of Cr particles. The welding durability was also improved with lowering contact resistance. Here, as atomization, gas atomization is preferable because of lesser amount of residual gas. As for gas atomization, using inert gas, such as Ar and $N_2$ gas, is preferable, however, Ar gas is more preferable to prevent nitriding.

Metal powder having melting point lower than Cu (hereinafter, the metal powder) may be blended with Cu-Cr alloyed powder obtained by atomization. Mixture of Cu and Cr was melted under atmosphere of unoxidized, such as vacuumed condition. The molten mixture was rapidly solidified by gas atomization using Ar gas under 5 to 8 MPa of pressure to obtain fine particle of Cu-Cr alloyed powder in which Cr particles were uniformly dispersed in a Cu matrix. Content ratio of Cu to Cr in the mixture before melting was determined to 4:1. When Cr content exceeds this ratio, Cu particles are dispersed in a Cr matrix, therefore, desired Cu-Cr alloyed powder cannot be obtained. Here, in order to further reduce oxygen content in the molten mixture, oxygen content of Cr material was preliminarily reduced. The mixture of Cu and Cr powder was melted in atmosphere of inert gas, or deoxidized to reduce oxygen content in the molten mixture until less than 1000 ppm. Contamination by inevitable impurities, such as Fe or Ni, was allowed. Mean diameter of the Cu-Cr alloyed powder obtained was less than 150 μm. Content ratio of Cu and Cr of the alloyed powder was equal to that of the mixture of Cu and Cr powder. According to a microscopic examination, Cr particle dispersed in the Cu matrix was sufficiently fined to less than 5 μm and dispersed uniformly.

Preparation of Sample A

Cu-Cr alloyed powder having 150 μm of diameter and mean diameter of Cr particles was 3.5 μm was obtained as aforementioned. Cr amount against Cu amount was 20 wt %. Bismuth (Bi) powder having −275 mesh of diameter was uniformly blended with Cu-Cr alloyed powder. Bi amount was determined to 0.5 wt % against the amount of alloyed powder. The mixture of powder was filled into a die having 50 mm of diameter, then compacted to a disc under 3,5 ton/cm$^2$ of pressure to obtain a green compact. The green compact was sintered by heating at 1080° C. for 30 min in a vacuum furnace of $5\times10^{-5}$ Torr. Thus, each metal particles can be finely integrated by sintering without coarsening of Cr particle. After sintering, Bi amount in the sintered article was 0.19 wt %. This comes from that certain amount of Bi was evaporated during sintering, because melting point thereof is lower than Cu. The sintered article was mechanically processed in a spiral electrode having 40 mm of diameter, then assembled in the vacuum interrupter of FIG. 1.

Preparation of Sample B

Lead (Pb) powder having −275 mesh of diameter was uniformly blended with Cu-Cr alloyed powder having same construction of the Sample A. Pb amount was determined to 0.5 wt % against the amount of alloyed powder. The mixture of powder was filled into a die having 50 mm of diameter, then compacted to a disc under 3,5 ton/cm$^2$ of pressure to obtain a green compact. The green compact was sintered by heating at 1080° C. for 30 min in a vacuum furnace of $5\times10^{-5}$ Torr. After sintering, Pb amount in the sintered article was 0.45 wt %. The sintered article was mechanically processed in a spiral electrode having 40 mm of diameter, then assembled in the vacuum interrupter of FIG. 1.

Preparation of Sample C

Tellurium (Te) powder having −275 mesh of diameter was uniformly blended with Cu-Cr alloyed powder having same construction of the Sample A. Te amount was determined to 0.5 wt % against the amount of alloyed powder. The mixture of powder was filled into a die having 50 mm of diameter, then compacted to a disc under 3,5 ton/cm$^2$ of pressure to obtain a green compact. The green compact was sintered by heating at 1080° C. for 30 min in a vacuum furnace of $5\times10^{-5}$ Torr. After sintering, Te amount in the sintered article was 0.45 wt %. The sintered article was mechanically processed in a spiral electrode having 40 mm of diameter, then assembled in the vacuum interrupter of FIG. 1.

Preparation of comparison

Copper(Cu) powder having 100 μm of diameter, chromium(Cr) powder having 80 μm of diameter and bismuth(Bi) powder having −275 mesh of diameter were uniformly blended by weight ratio of 79.95:19.75:0.5. The blended powder was filled into a die having 50 mm of diameter, then compacted to a disc under 3.5 ton/cm$^2$ of pressure to obtain a green compact. The green compact was sintered by heating at 1080° C. for 30 min. in a vacuum furnace of $5\times10^{-5}$ Torr. The sintered article was mechanically processed in a spiral electrode having 40 mm of diameter, then assembled in the vacuum interrupter of FIG. 1.

Breaking-current, contact resistance and welding force of the Sample A, B, and Comparison were respectively measured. The obtained results are shown in Table 2.

Here, breaking current value was the value when 7.2 kV of alternating voltage with 50 Hz was applied during 0.4 cycle of arc generation, contact resistance value was the value when the electrodes 13 and 14 were compressed under 500N (Newton), and welding force value was the static value after two cycles of application of alternating current having peak current of 35 kA to the electrodes 13 and 14 under compressing thereof at 500N.

TABLE 2

| | Sample A | Sample B | Sample C | Comparison |
|---|---|---|---|---|
| Breaking Current (kA) | 22 | 21 | 23 | 18 |
| Contact Resistance (μΩ) | 14 | 15 | 13 | 20 |
| Welding Force (N) | 800 | 950 | 850 | 1800 |

It was indicated by the results shown in the table that arc generated was smoothly diffused because fine particles of Cr and metal powder having lower melting point were sufficiently uniformly dispersed in the Cu matrix as the aforementioned. Therefore, current breaking ability was improved compared from the comparison formed by the process only blending powder. In addition, contact resistance and welding durability were improved by addition of metal having lower melting point.

Alternatively, Bi may be added to the molten mixture of Cu and Cr.

EXAMPLE 1

Cu ingot was put into a fire resisting crucible, then heated to 1200° C. under unoxidized atmosphere, such as Ar gas, nitrogen ($N_2$) gas and vacuum, to melt Cu in the crucible. Cr having a small briquette form was put into the crucible, then heated to 1700° C. under unoxidized atmosphere. After Cr was completely melted, bismuth was put into the crucible to obtain a molten mixture of Cu-Cr-Bi. The molten mixture was rapidly solidified to fine particles by gas atomization using Ar gas under 5 to 8 MPa to obtain Cu-Cr-Bi alloyed powder in which Cr is uniformly dispersed in a Cu matrix. Content ratio of Cu:Cr:Bi before melting was determined to 80:20:1. When Cr content ratio exceeds 20 wt %, alloyed powder of Cu particles are dispersed in a Cr matrix is formed. On the other hand, when Cr content ratio does not exceed 5 wt %, effects of Cr addition, i.e., improving current breaking ability, cannot be obtained. In order to further reduce oxygen content in the molten mixture, oxygen content of Cr and Bi powder were preliminarily reduced. Melting of metals in atmosphere of inert gas, or deoxidizing was accomplished to reduce oxygen content in the molten mixture until less than 1000 ppm. Contamination by inevitable impurities, such as Fe or Ni, was allowed. Mean particle diameter of Cu-Cr-Bi alloyed powder obtained was less than 150 μm. Content ratio of Bi was 0.5 wt % according to chemical analysis. According to a microscopic examination, Cr particle dispersed in the Cu matrix was sufficiently fined to less than 5 μm and dispersed uniformly. Cu-Cr-Bi alloyed fine powder obtained by the atomization was filled in a die having 50 mm of diameter, then compacted under pressure of 3.5 ton/cm$^2$ to a disc. The disc was sintered by heating at 30 min at 1080° C. in a vacuum of $5\times10^{-5}$ torr. Content of Bi in the sintered disc was measured about 10 samples prepared by the process as the aforementioned. The obtained results are shown in item A of Table 3.

Alternatively, Cu-Cr alloyed fine powder obtained by the atomization was mixed with 0.5 wt % of Bi powder against the amount of Cu-Cr alloyed powder. The mixture of powder was filled in a die having 50 mm of diameter, then compacted under pressure of 3.5 ton/cm$^2$ to a disc. The disc was sintered by heating at 1080° C. for 30 min. in a vacuum condition of $5\times10^{-5}$ torr. Content of bismuth in the sintered disc was measured about 10 samples. The obtained results are shown in item B of Table 3.

As a comparison, Cu powder, Cr powder and 0.5 wt % of Bi powder were mixed. Then, the mixture of powder (not atomized) was filled in a die having 50 mm of diameter, then compacted under pressure of 3.5 ton/cm$^2$ to a disc. The disc was sintered by heating at 30 min at 1080° C. in a vacuum of $5\times10^{-5}$ torr. Content of Bi in the sintered disc was measured about 10 samples. The obtained results are also shown in C item of Table 3.

TABLE 3

| | Bi Content in the Sintered Disc | | |
|---|---|---|---|
| Sample No. | A (wt %) | B (wt %) | C (wt %) |
| 1 | 0.21 | 0.19 | 0.25 |
| 2 | 0.25 | 0.15 | 0.21 |
| 3 | 0.24 | 0.24 | 0.24 |
| 4 | 0.18 | 0.13 | 0.18 |
| 5 | 0.20 | 0.21 | 0.12 |
| 6 | 0.21 | 0.19 | 0.22 |
| 7 | 0.27 | 0.10 | 0.21 |
| 8 | 0.20 | 0.26 | 0.09 |
| 9 | 0.19 | 0.12 | 0.25 |
| 10 | 0.23 | 0.22 | 0.22 |
| Mean | 0.22 | 0.18 | 0.20 |
| SD | 0.029 | 0.054 | 0.054 |

EXAMPLE 2

Cu ingot was put into a fire resisting crucible, then heated at 1200° C. under unoxidized atmosphere, such as vacuumed condition, to melt Cu in the crucible. Small briquette of Cr was put in the crucible, then heated until 1700° C. under the same atmosphere as the aforementioned Example 1 to obtain the molten mixture of Cu and Cr. After Cr was completely melted, 0.7 wt % of Pb against the amount of the molten mixture was put into the crucible. Thus, Cu-Cr-Pb molteh mixture was obtained. Cu-Cr-Pb mixture was rapidly solidified by gas atomization using Ar gas under 5 to 8 MPa of pressure. The molten mixture was fined to powder, thus, Cu-Cr-Pb alloyed fine powder in which Cr particles were uniformly dispersed in a Cu matrix was obtained. Diameter of the Cu-Cr-Pb alloyed powder was less than 150 μm, and content ratio of Pb was 0.5 wt % according to chemical analysis. Furthermore, according to microscopic analysis, Cr particles were fined to less than 5 μm and uniformly dispersed in the Cu matrix. Cu-Cr-Pb alloyed powder was filled in a die having 50 mm of diameter, then compacted to a disc under 3.5 ton/cm$^2$. The disc was heated at 1080° C. for 30 min. in vacuumed condition of $5\times10^{-5}$ Torr to obtain a sintered article. Pb content included in the sintered article was measured about 10 samples. The results are shown in item A of Table 4.

Alternatively, Pb powder was added to Cu-Cr atomized alloyed powder. The content ratio of lead was 0.5 wt % against the amount of the alloyed powder. Then the mixture of powder was sintered to obtain Cu-Cr-Pb alloy. Pb content included in the alloy was measured about 10 samples. The results are shown in item B of Table 4.

As a comparison, Cu, Cr and Pb powder were mixed. Content ratio of Pb was determined to 0.5 wt % against the total amount of Cu and Cr powder. The mixture of powder was sintered to obtain Cu-Cr-Pb alloy. Pb content included in the alloy was measured about 10 samples. The results are shown in item C of Table 4.

TABLE 4

| Sample No. | A (wt %) | B (wt %) | C (wt %) |
|---|---|---|---|
| 1 | 0.45 | 0.15 | 0.35 |
| 2 | 0.42 | 0.21 | 0.21 |
| 3 | 0.46 | 0.18 | 0.10 |
| 4 | 0.45 | 0.19 | 0.32 |
| 5 | 0.41 | 0.23 | 0.26 |
| 6 | 0.39 | 0.12 | 0.28 |
| 7 | 0.38 | 0.14 | 0.18 |
| 8 | 0.43 | 0.13 | 0.31 |
| 9 | 0.42 | 0.18 | 0.17 |
| 10 | 0.40 | 0.15 | 0.32 |
| Mean | 0.42 | 0.17 | 0.25 |
| SD | 0.027 | 0.036 | 0.082 |

It is clear from Table 4, evaporation of Pb during sintering can be sufficiently reduced when Pb powder is blended with the molten mixture of Cu and Cr powder before atomizing thereof. In addition, data variation is not found.

EXAMPLE 3

Cu-Cr-Te molten mixture was obtained by similarly to the process as the aforementioned Example 1 and 2. The Cu-Cr-Te mixture was rapidly solidified by gas atomization using Ar gas under 5 to 8 MPa of pressure. The molten mixture was fined to powder, thus, Cu-Cr-Te alloyed fine powder in which Cr particles were uniformly dispersed in a Cu matrix was obtained. Diameter of the Cu-Cr-Te alloyed powder was less than 150 μm, and content ratio of Te was 0.5 wt % according to chemical analysis. Furthermore, according to microscopic analysis, Cr particles were fined to less than 5 μm, and uniformly dispersed in the Cu matrix. Cu-Cr-Te alloyed powder was filled in a die having 50 mm of diameter, then compacted to a disc under 3.5 ton/cm$^2$. The disc was heated at 1080° C. for 30 min. in vacuumed condition of $5\times10^{-5}$Torr to obtain a sintered article. Te content included in the sintered article was measured about 10 samples. The results are shown in item A of Table 5.

Alternatively, Te powder was added to the Cu-Cr atomized alloyed powder. The content ratio of Te was 0.5 wt % against the amount of the alloyed powder. Then the mixture of powder was sintered to obtain Cu-Cr-Te alloy. Te content included in the alloy was measured about 10 samples. The results are shown in item B of Table 5.

As a comparison, Cu, Cr and Te powder were mixed. Content ratio of Te was determined to 0.5 wt % against the total amount of Cu and Cr powder. The mixture of powder was sintered to obtain Cu-Cr-Te alloy. Te content included in the alloy was measured about 10 samples. The results are shown in item C of Table 5.

It is clear from Table 5, evaporation of Te during sintering can be sufficiently reduced when Te powder is blended with the molten mixture of Cu and Cr powder before atomizing thereof. In addition, data variation is not found.

TABLE 5

| | Te Content in the Sintered Article | | |
|---|---|---|---|
| Sample No. | A (wt %) | B (wt %) | C (wt %) |
| 1 | 0.47 | 0.45 | 0.36 |
| 2 | 0.45 | 0.42 | 0.48 |
| 3 | 0.48 | 0.38 | 0.31 |
| 4 | 0.45 | 0.46 | 0.46 |
| 5 | 0.46 | 0.41 | 0.45 |
| 6 | 0.46 | 0.42 | 0.35 |
| 7 | 0.48 | 0.43 | 0.47 |
| 8 | 0.42 | 0.46 | 0.50 |
| 9 | 0.46 | 0.39 | 0.30 |
| 10 | 0.47 | 0.42 | 0.75 |
| Mean | 0.46 | 0.42 | 0.41 |
| SD | 0.018 | 0.027 | 0.075 |

EXAMPLE 4

Each sample shown in Tables 3 to 6 was respectively mechanically processed in a spiral electrode, then assembled in the vacuum interrupter of FIG. 1. Contact resistance and Welding force were respectively measured. Here, contact resistance value was the value when the electrodes 13 and 14 were compressed under 500N, and welding force value was the static value after two cycles of application of alternating current with 50 Hz having peak current of 35 kA to the electrodes 13 and 14 under compressing thereof at 500N. The obtained results of contact resistance and welding force about samples of Table 3 are respectively shown in Table 6 and 7. Similarly, those about samples of Table 4 are shown in Table 8 and 9, and those about samples of Table 5 are shown in Table 10 and 11, respectively.

TABLE 6

| | Contact resistance (Bi Addition) | | |
|---|---|---|---|
| Sample No. | B (μΩ) | A (μΩ) | D (μΩ) |
| 1 | 14 | 19 | 18 |
| 2 | 15 | 22 | 19 |
| 3 | 14 | 15 | 22 |
| 4 | 13 | 14 | 24 |
| 5 | 15 | 16 | 20 |
| 6 | 14 | 20 | 18 |
| 7 | 13 | 15 | 20 |
| 8 | 13 | 22 | 19 |
| 9 | 14 | 18 | 22 |
| 10 | 14 | 17 | 22 |
| Mean | 14 | 18 | 20 |

It is clear from Table 6, when bismuth is added to the mixture of Cu and Cr powder, i.e., item A of the table, contact resistance can be relatively reduced.

TABLE 7

| | Welding Force (Bi Addition) | | |
|---|---|---|---|
| Sample No. | B (N) | A (N) | D (N) |
| 1 | 700 | 900 | 1600 |
| 2 | 1000 | 1100 | 1400 |
| 3 | 800 | 1000 | 1800 |
| 4 | 1400 | 2400 | 2000 |
| 5 | 1000 | 1100 | 2200 |
| 6 | 600 | 1200 | 2500 |
| 7 | 900 | 2200 | 2300 |
| 8 | 1000 | 1200 | 2000 |
| 9 | 800 | 1600 | 1900 |
| 10 | 900 | 1600 | 2200 |
| Mean | 900 | 1400 | 2000 |

It is clear from Table 7, when bismuth is added to the mixture of Cu and Cr powder, welding force can be relatively reduced, i.e., welding durability can be relatively improved.

TABLE 8

| | Contact resistance (Pb Addition) | | |
|---|---|---|---|
| Sample No. | A (μΩ) | B (μΩ) | C (μΩ) |
| 1 | 13 | 17 | 24 |
| 2 | 15 | 16 | 18 |
| 3 | 15 | 16 | 22 |
| 4 | 16 | 17 | 19 |
| 5 | 15 | 22 | 18 |
| 6 | 14 | 22 | 24 |
| 7 | 13 | 19 | 21 |
| 8 | 14 | 16 | 22 |
| 9 | 15 | 17 | 18 |
| 10 | 14 | 17 | 21 |
| Mean | 14 | 18 | 21 |

It is clear from Table 8, when Pb is added to the mixture of Cu and Cr powder, i.e., item A of the table, contact resistance can be relatively reduced.

TABLE 9

| | Welding Force (Pb Addition) | | |
|---|---|---|---|
| Sample No. | A (N) | B (N) | C (N) |
| 1 | 1200 | 2400 | 1700 |
| 2 | 1400 | 1800 | 1900 |
| 3 | 1300 | 1800 | 1600 |
| 4 | 1500 | 2200 | 2400 |
| 5 | 1000 | 1200 | 2200 |
| 6 | 1200 | 1400 | 1900 |
| 7 | 800 | 1000 | 2400 |
| 8 | 1300 | 2200 | 1800 |
| 9 | 1000 | 1200 | 2200 |
| 10 | 1200 | 1600 | 2200 |
| Mean | 1200 | 1700 | 2000 |

It is clear from Table 9, when Pb is added to the mixture of Cu and Cr powder, welding force can be relatively reduced, i.e., welding durability can be relatively improved.

TABLE 10

| | Contact resistance (Te Addition) | | |
|---|---|---|---|
| Sample No. | A (μΩ) | B (μΩ) | C (μΩ) |
| 1 | 15 | 16 | 19 |
| 2 | 16 | 22 | 19 |
| 3 | 15 | 17 | 18 |
| 4 | 14 | 15 | 24 |
| 5 | 14 | 15 | 21 |
| 6 | 15 | 20 | 22 |
| 7 | 15 | 18 | 21 |
| 8 | 16 | 19 | 20 |

TABLE 10-continued

| Contact resistance (Te Addition) | | | |
|---|---|---|---|
| Sample No. | A (μΩ) | B (μΩ) | C (μΩ) |
| 9 | 14 | 15 | 21 |
| 10 | 15 | 18 | 20 |
| Mean | 15 | 18 | 21 |

It is clear from Table 10, when Te is added to the mixture of Cu and Cr powder, i.e., item A of the table, contact resistance can be relatively reduced.

TABLE 11

| Welding Force (Te Addition) | | | |
|---|---|---|---|
| Sample No. | A (N) | B (N) | C (N) |
| 1 | 700 | 1200 | 1500 |
| 2 | 1100 | 2400 | 1600 |
| 3 | 800 | 1800 | 2600 |
| 4 | 1300 | 2100 | 2200 |
| 5 | 1000 | 1200 | 2400 |
| 6 | 800 | 1200 | 2000 |
| 7 | 1100 | 1600 | 2200 |
| 8 | 600 | 2000 | 1800 |
| 9 | 1000 | 1200 | 2400 |
| 10 | 800 | 1600 | 2000 |
| Mean | 900 | 1600 | 2100 |

It is clear from Table 11, when tellurium is added to the mixture of Cu and Cr powder, welding force can be relatively reduced, i.e., welding durability can be relatively improved.

Bismuth powder may be added to Cu powder to form Cu-Bi alloyed powder by atomization, and Cu-Bi alloyed powder may be blended with Cu-Cr alloyed powder, then sintered the mixture of alloyed powder by heating under unoxidized atmosphere.

EXAMPLE 5

Cu ingot was put into a fire resisting crucible, then heated to 1200° C. under unoxidized atmosphere, such as Ar gas, nitrogen ($N_2$) gas and vacuum, to melt Cu in the crucible. Chromium having a small briquette form was put into the crucible, then heated to 1700° C. under unoxidized atmosphere. The molten mixture was rapidly solidified to fine particles by gas atomization using Ar gas under 5 to 8 MPa to obtain Cu-Cr alloyed powder in which Cr particles are uniformly dispersed in a Cu matrix. Diameter of the alloyed powder atomized was less than 150 μm and mean diameter of chromium particles was 3.5 μm. On the other hand, Cu is melted in another fire resisting crucible at 1200° C., then 30 wt % of Bi against the amount of Cu was put thereinto to obtain a molten mixture of Cu and Bi. The molten mixture was atomized with Ar gas under 5 to 8 MPa of pressure. Cu-Bi alloyed powder atomized having powder diameter of less than 100 μm was obtained. Bismuth content in the alloyed powder was 25 wt % according to chemical analysis. In order to further reduce oxygen content in the molten mixture, oxygen content of Cr and Bi were preliminarily reduced. On the other hand, melting of metals in atmosphere of inert gas, or deoxidizing was accomplished to reduce oxygen content in the molten mixture until less than 1000 ppm. Contamination by inevitable impurities, such as Fe or Ni, was allowed. According to a microscopic examination, Cr particles dispersed in the Cu matrix were sufficiently fined to less than 5 μm and dispersed uniformly. Cu-Cr alloyed powder and Cu-Bi alloyed powder were blended so as to contain 0.5 wt % of bismuth, then the mixture of alloyed powder was filled in a die having 50 mm of diameter, then compacted under pressure of 3.5 ton/cm$^2$ to a disc. The disc was sintered by heating at 30 min at 1080° C. in a vacuum of $5\times10^{-5}$ torr. Content of Bi in the sintered disc was measured about 10 samples. The obtained results are shown in item A of Table 12. For comparison, results of items B and C of Table 3 are appended.

TABLE 12

| Bi Content in the Sintered Disc | | | |
|---|---|---|---|
| Sample No. | A (wt %) | B (wt %) | C (wt %) |
| 1 | 0.24 | 0.19 | 0.25 |
| 2 | 0.26 | 0.15 | 0.21 |
| 3 | 0.25 | 0.24 | 0.24 |
| 4 | 0.21 | 0.13 | 0.18 |
| 5 | 0.20 | 0.21 | 0.12 |
| 6 | 0.24 | 0.19 | 0.22 |
| 7 | 0.25 | 0.10 | 0.21 |
| 8 | 0.24 | 0.26 | 0.09 |
| 9 | 0.23 | 0.12 | 0.25 |
| 10 | 0.27 | 0.22 | 0.22 |
| Mean | 0.24 | 0.18 | 0.20 |
| SD | 0.021 | 0.054 | 0.054 |

As shown in Table 12, bismuth amount contained is not varied comparing from that of items B and C, therefore, evaporation thereof during sintering can be sufficiently minimized. The obtained Cu-Bi alloyed powder has a construction of fine Bi particles are uniformly dispersed in the Cu matrix. Cu-Cr alloyed powder also has a construction of fine Cr particles are uniformly dispersed in the Cu matrix. Thus, by means of blending these alloyed powder, metal particles can be finely integrated by sintering without coarsening of Cr particle and evaporation of bismuth. Here, Bi content against Cu content is appropriately determined in a range of 10 to 50 wt %. When the content does not exceed 10 wt %, amount of Cu-Bi alloyed powder must be determined higher than that of Cu-Cr alloyed powder. This causes increase of total amount of Cu which deteriorates current breaking ability. On the other hand, when the content exceeds 50 wt %, evaporating amount of bismuth significantly increases during forming Cu-Bi alloyed powder. Additionally, Bi is crystallized then causes concentration difference of the bismuth in the alloyed powder, which is present between the Cu crystals. Therefore, quality of the obtained alloyed powder cannot be evened.

EXAMPLE 6

Molten mixture of Cu and Cr was prepared similarly as Example 5. Then, the molten mixture was atomized under same condition of Example 5 to obtain Cu-Cr atomized alloyed powder. On the other hand, cu ingot was put into another fire resisting crucible, then heated at 1200° C. under same condition of the Example 5. 27 wt % of Pb against the Cu amount was put into the crucible to obtain molten mixture of Cu and Pb. Then, the molten mixture was atomized under same condition as Example 5 to obtain Cu-Pb atomized alloyed powder having less than 100 μm of diameter. Pb content included in the alloyed powder was 25 wt % according to chemical analysis. Cu-Cr alloyed powder and Cu-Pb alloyed powder was blended so as to have 0.5 wt % of Pb therein. The mixture of Cu-Cr and Cu-Pb alloyed powder was filled in a die having 50 mm of diameter, then compacted to a disc under 3.5 ton/cm$^2$. The disc was heated at 1080° C. for 30 min. in vacuumed condition of $5\times10^{-5}$Torr to obtain a sintered article. Pb content included in the sintered article was measured about 10 samples. The results are shown in item A of Table 13.

Alternatively, Pb powder was added to Cu-Cr atomized alloyed powder. The content ratio of Pb was 0.5 wt % against the amount of the alloyed powder. Then the mixture of powder was sintered to obtain Cu-Cr-Pb alloy. Pb content included in the alloy was measured about 10 samples. The results are shown in item B of Table 13.

As a comparison, Cu, Cr and Pb powder were blended. Content ratio of Pb was determined to 0.5 wt % against the total amount of Cu and Cr powder. The mixture of powder was sintered to obtain Cu-Cr-Pb alloy. Pb content included in the alloy was measured about 10 samples. The results are shown in item C of Table 13.

TABLE 13

| | Pb Content in the Sintered Article | | |
|---|---|---|---|
| Sample No. | A (wt %) | B (wt %) | C (wt %) |
| 1 | 0.42 | 0.15 | 0.35 |
| 2 | 0.46 | 0.21 | 0.21 |
| 3 | 0.43 | 0.18 | 0.10 |
| 4 | 0.40 | 0.19 | 0.32 |
| 5 | 0.47 | 0.23 | 0.26 |
| 6 | 0.42 | 0.12 | 0.28 |
| 7 | 0.41 | 0.14 | 0.18 |
| 8 | 0.40 | 0.13 | 0.31 |
| 9 | 0.42 | 0.18 | 0.17 |
| 10 | 0.41 | 0.15 | 0.32 |
| Mean | 0.42 | 0.17 | 0.25 |
| SD | 0.024 | 0.036 | 0.082 |

It is clear from Table 13, evaporation of Pb during sintering can be sufficiently reduced when Cu-Pb alloyed powder is blended with Cu-Cr alloyed powder. In addition, data variation is not found.

Each sample shown in Table 13 was respectively mechanically processed ina spiral electrode, then assembled in the vacuum interrupter of FIG. 1. Contact resistant and welding durability were respectively measured. When Cu-Pb alloyed powder is blended with Cu-Cr alloyed powder, contact resistance can be reduced compared with the process of blending Pb before atomization or blending each powder without atomization.

EXAMPLE 7

Cu-Cr alloyed powder was prepared by similar process as Example 5, on the other hand, Cu ingot was put into another fire resisting crucible, then heated at 1200° C. under same condition of the Example 5. 27 wt % of Te against the Cu amont was put into the crucible to obtain molten mixture of Cu and Te. Then, the molten mixture was atomized under same condition as the previously mentioned to obtain Cu-Te atomized alloyed powder having less than 100 μm of diameter. Te content included in the alloyed powder was 25 wt % according to chemical analysis. Cu-Cr alloyed powder and Cu-Te alloyed powder was blended so as to have 0.5 wt % of tellurium therein. The mixture of Cu-Cr and Cu-Te alloyed powder was filled in a die having 50 mm of diameter, then compacted to a disc under 3.5 ton/cm$^2$. The disc was heated at 1080° C. for 30 min. in vacuumed condition of $5\times10^{-5}$Torr to obtain a sintered article. Te content included in the sintered article was measured about 10 samples. The results are shown in item A of Table 14.

Alternatively, Te powder was blended with Cu-Cr atomized alloyed powder. The content ratio of Te was 0.5 wt % against the amount of the alloyed powder. Then the mixture of powder was sintered to obtain Cu-Cr-Te alloy. Te content included in the alloy was measured about 10 samples. The results are shown in item B of Table 14.

As a comparison, Cu, Cr and Te powder were blended. Content ratio of tellurium was determined to 0.5 wt % against the total amount of Cu and Cr powder. The mixture of powder was sintered to obtain Cu-Cr-Te alloy. Tellurium content included in the alloy was measured about 10 samples. The results are shown in item C of Table 14.

TABLE 14

| | Te Content in the Sintered Article | | |
|---|---|---|---|
| Sample No. | A (wt %) | B (wt %) | C (wt %) |
| 1 | 0.41 | 0.45 | 0.36 |
| 2 | 0.48 | 0.42 | 0.48 |
| 3 | 0.40 | 0.38 | 0.31 |
| 4 | 0.40 | 0.46 | 0.46 |
| 5 | 0.41 | 0.41 | 0.45 |
| 6 | 0.42 | 0.42 | 0.35 |
| 7 | 0.46 | 0.43 | 0.47 |
| 8 | 0.44 | 0.46 | 0.50 |
| 9 | 0.42 | 0.39 | 0.30 |
| 10 | 0.43 | 0.42 | 0.75 |
| Mean | 0.46 | 0.42 | 0.41 |
| SD | 0.018 | 0.027 | 0.075 |

It is clear from Table 14, evaporation of tellurium during sintering can be sufficiently reduced when Cu-Te alloyed powder is blended with Cu-Cr alloyed powder. In addition, data variation is not found.

Each sample shown in Table 14 was respectively mechanically processed in a spiral electrode, then assembled in the vacuum interrupter of FIG. 1. Contact resistivity and Welding durability were respectively measured. When Cu-Te alloyed powder is blended with Cu-Cr alloyed powder, contact resistance can be reduced compared with the process of blending tellurium before atomization or blending each powder without atomization.

According to the present invention, current breaking ability of the electrode can be sufficiently improved because oxygen content included in the sintered article to be formed into the electrode is sufficiently reduced to less than 0.15 wt %. Oxygen content of the sintered article can be reduced by preliminarily reducing that included in Cr powder as a material to less than 0.1 wt %.

When a metal having melting point lower than Cu is blended with Cu-Cr atomized alloyed powder, current breaking ability can also be improved, further to say, contact resistivity of the electrode can be significantly reduced and welding durability thereof can also be significantly improved.

Alternatively, when such metal is blended in the mixture of Cu and Cr powder before atomization, further improvement can be obtained about contact resistivity and welding durability. In addition content of the metal becomes constant. Similar improvement can be obtained when the alloyed powder of Cu and such metal is formed and blended with Cu-Cr alloyed powder.

As the metal to be blended, one or mixture of the metal having melting point lower than Cu which is selected from the group consisting of bismuth, lead, tellurium, antimony and selenium may be used.

Preferred content of the metal included in the sintered article may be determined in the range of 0.02 to 3.0 wt %. When the content does not exceed 0.02 wt %, effects of adding the metal powder, i.e., lowering contact resistivity and improving welding durability are not obtained. On the other hand, when the content exceeds 3.0 wt %, current breaking ability is rapidly deteriorated.

While the present invention has been disclosed in terms of the preferred embodiment in order to facilitate better understanding of the invention, it should be appreciated that the invention can be embodied in various ways without depending from the principle of the invention. Therefore, the invention should be understood to include all possible embodiments and modification to the shown embodiments which can be embodied without departing from the principle of the inventions as set forth in the appended claims.

What is claimed is:

1. A process for forming contact material of an electrode comprising the steps of:

preparing chromium of which oxygen content is substantially reduced to less than 0.1 wt %, forming a molten mixture of said chromium and copper, atomizing said molten mixture into fine particles to obtain Cu-Cr alloyed powder, compacting said Cu-Cr alloyed powder under desired pressure, and sintering said compacted alloyed powder.

2. A process as set forth in claim 1, wherein said atomizing is accomplished by gas atomization.

3. A process as set forth in claim 2, wherein said gas is inert gas.

4. A process as set forth in claim 2, wherein said gas is argon gas.

5. A process as set forth in claim 1, wherein said sintering is done under the condition of unoxidized atmosphere.

6. A process as set forth in claim 1, wherein said process further includes a step of adding a metal having melting point lower than copper.

7. A process as set forth in claim 6, wherein said metal is selected from one or mixture of the metals consisting of bismuth, lead, tellurium, antimony and selenium.

8. A process as set forth in claim 6, wherein said metal is contained in a range of 0.02 to 3.0 wt % against the total amount of copper and chromium.

9. A process as set forth in claim 6, wherein said metal is blended in said Cu-Cr alloyed powder.

10. A process as set forth in claim 6, wherein said metal is blended in said molten mixture of copper and chromium.

11. A process as set forth in claim 1, further comprising the steps of:

forming a second molten mixture of copper and a metal having melting point lower than copper, atomizing said second molten mixture into fine particules to obtain alloyed powder of copper and the metal, and blending said Cu-Cr alloyed powder with said alloyed powder of copper and the metal.

12. A process as set forth in claim 11, wherein said metal is selected from one or mixture of the metals consisting of bismuth, lead, tellurium, antimony and selenium.

13. A process as set forth in claim 11, wherein said metal is contained in a range of 0.02 to 3.0 wt % against the total amount of copper and chromium.

14. A process as set forth in claim 11, wherein said metal is contained in a range of 10 to 50 wt % against the amount of copper.

15. A process for forming contact material of an electrode comprising the steps of:

preparing chromium of which oxygen content is substantially reduced to less than 0.1 wt %, forming a mixture of alloyed powder of copper, said chromium and a metal having melting point lower than copper, by atomization, and sintering said alloyed power.

16. A process as set forth in claim 15, wherein said sintering is done under the condition of unoxidized atmosphere.

17. A process as set forth in claim 15, wherein said metal is selected from one or mixture of the metals consisting of bismuth, lead, tellurium, antimony and selenium.

18. A process as set forth in claim 15, wherein said metal is contained in a range of 0.02 to 3.0 wt % against the total amount of copper and chromium.

* * * * *